US012710046B2

(12) United States Patent
Yoshida

(10) Patent No.: US 12,710,046 B2
(45) Date of Patent: Aug. 18, 2026

(54) BLOWER

(71) Applicant: SHINANO KENSHI CO., LTD., Ueda (JP)

(72) Inventor: Naomasa Yoshida, Nagano (JP)

(73) Assignee: SHINANO KENSHI CO., LTD., Ueda (JP)

( * ) Notice: Subject to any disclaimer, the term of this patent is extended or adjusted under 35 U.S.C. 154(b) by 0 days.

(21) Appl. No.: 18/752,187

(22) Filed: Jun. 24, 2024

(65) Prior Publication Data

US 2025/0146499 A1 May 8, 2025

(30) Foreign Application Priority Data

Nov. 7, 2023 (JP) ..... 2023-190199

(51) Int. Cl.
*F04D 25/06* (2006.01)
*F04D 29/28* (2006.01)

(52) U.S. Cl.
CPC ..... *F04D 25/0693* (2013.01); *F04D 29/281* (2013.01)

(58) Field of Classification Search
CPC ..... F04D 25/068; F04D 25/0693; F04D 29/0281; F04D 29/068; F04D 29/0693
See application file for complete search history.

(56) References Cited

U.S. PATENT DOCUMENTS 4,460,805 A * 7/1984 Johnson ..... H02G 3/088 174/152 G
4,773,828 A * 9/1988 Hagiwara ..... H01R 12/57 310/67 R
4,931,023 A * 6/1990 Browne ..... H01R 13/595 439/459
2019/0154056 A1* 5/2019 Godo ..... F04D 29/4226
2021/0254632 A1 8/2021 Umematsu

FOREIGN PATENT DOCUMENTS

JP H11-135191 A 5/1999
JP 2003-046270 A 2/2003
JP 2019-094832 A 6/2019
JP 2021-131021 A 9/2021

OTHER PUBLICATIONS

Icotek—Cable management systems—Product catalogue 33 (Year: 2021).*
Groth Music—Standard Chalkboard 5-line Chalk or Marker Holder (Year: 2024).*
Mar. 25, 2025 Office Action issued in Japanese Patent Application No. 2023-190199.

* cited by examiner

*Primary Examiner* — Essama Omgba
*Assistant Examiner* — Joseph S. Herrmann
(74) *Attorney, Agent, or Firm* — Oliff PLC

(57) ABSTRACT

A blower includes a case having an opening, an impeller disposed in the case, a motor disposed in the case and configured to drive the impeller, a grommet disposed in the case, a wiring, and a plug member. The grommet includes first and second holes that communicate between an inside and an outside of the case via the opening. The wiring is inserted into the first hole. The plug member closes the second hole.

3 Claims, 9 Drawing Sheets

BLOWER

CROSS-REFERENCE TO RELATED APPLICATION

This application is based upon and claims the benefit of priority of the prior Japanese Patent Application No. 2023-190199, filed on Nov. 7, 2023, the entire contents of which are incorporated herein by reference.

BACKGROUND

(i) Technical Field

The present disclosure relates to a blower.

(ii) Related Art

A blower having a grommet through which a wiring is inserted is known (See, for example, Japanese Unexamined Patent Application Publication No. 2021-131021).

The number of wires used varies depending on the model of the blower. Therefore, it is conceivable to use grommets having different numbers of holes for different models of blowers. In this case, however, multiple types of grommets need to be manufactured, which might increase manufacturing costs. Therefore, it is conceivable to manufacture a grommet provided with the same number of holes as the maximum number of wires that could be used in the blowers, and to share this grommet with the blowers of different models. This improves the versatility of the grommet. However, when such a grommet is used in common, the airtightness of the blower might be reduced through the holes of the grommet that are not used. This might reduce the blowing efficiency.

SUMMARY

According to an aspect of the present disclosure, there is provided a blower including: a case having an opening; an impeller disposed in the case; a motor disposed in the case and configured to drive the impeller; a grommet disposed in the case; a wiring; and a plug member, wherein the grommet includes first and second holes that communicate between an inside and an outside of the case via the opening, the wiring is inserted into the first hole, and the plug member closes the second hole.

DETAILED DESCRIPTION

[First Model of Blower]

Figure 1:
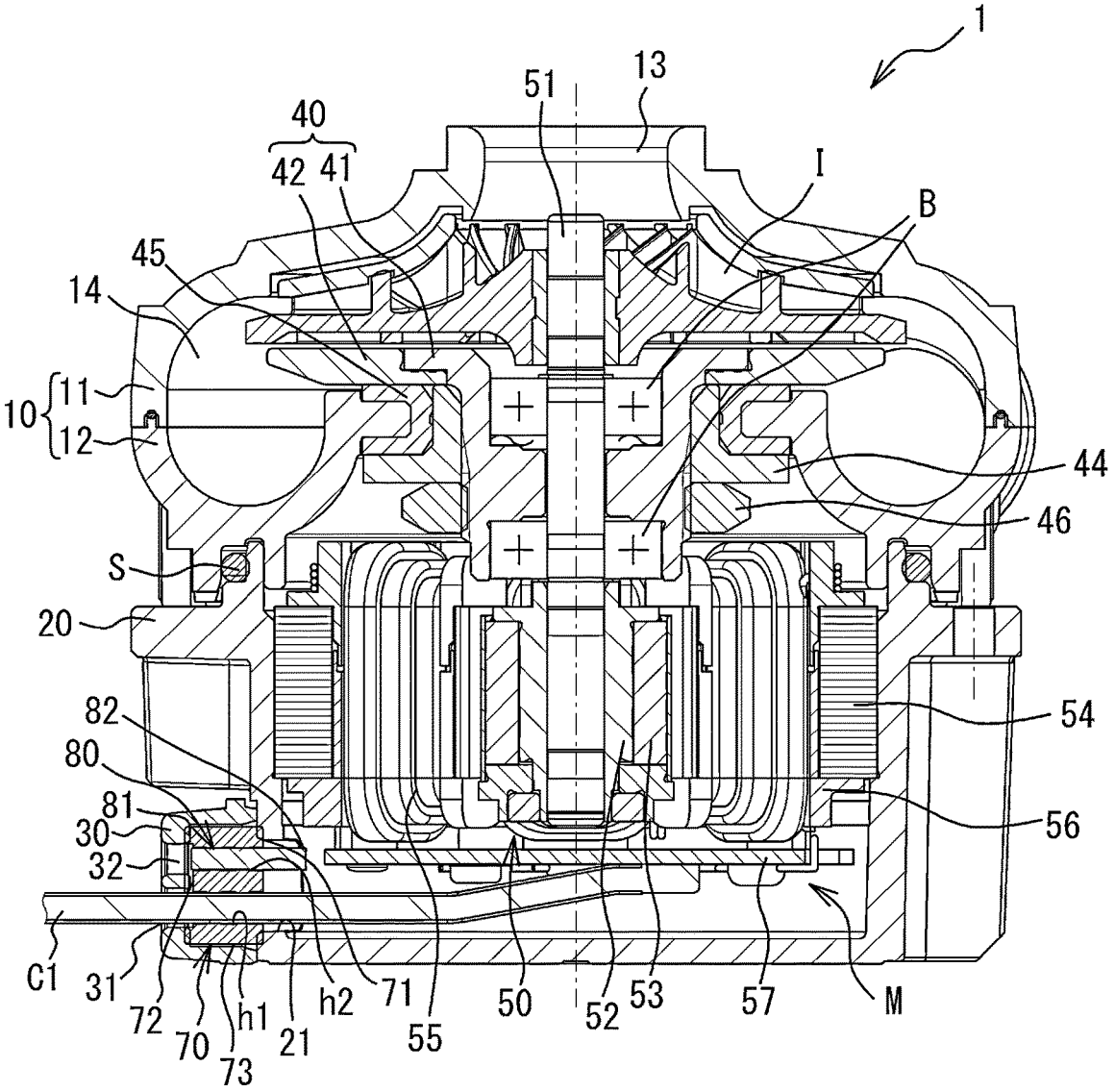
FIG. 1 is a sectional view of a first model of blower.

FIG. 1 is a sectional view of a blower 1 of a first model. The blower 1 includes an impeller case 10, a motor case 20, a grommet case 30, a bearing holding member 40, an impeller I, a motor M, a grommet 70, and a plug member 80. The impeller I is accommodated in the impeller case 10. The motor M is accommodated in the motor case 20. The grommet 70 is held in the grommet case 30. The impeller case 10 includes an upper case 11 and a lower case 12. A suction port 13 for taking gas into the impeller case 10 is formed at the center of the upper case 11. The upper case 11 faces the upper surface side of the impeller I. An annular air passage 14 is defined by a portion of the upper case 11 radially outward of the impeller I and the lower case 12. The gas introduced into the air passage 14 through the suction port 13 is discharged from a discharge port (not illustrated) formed in the impeller case 10. The lower case 12 is assembled to the motor case 20 via a ring-shaped seal member S. The impeller I is fixed to a distal end of a rotary shaft 51 described later.

The bearing holding member 40 includes a cylindrical portion 41 and a flange portion 42. The cylindrical portion 41 and the flange portion 42 face the lower surface side of the impeller I. The cylindrical portion 41 is substantially cylindrical. Two bearings B that rotatably support the rotary shaft 51 are held inside the cylindrical portion 41. The flange portion 42 is fixed to an upper end portion of the cylindrical portion 41. A collar 44 is fixed to the outer peripheral portion of the cylindrical portion 41. A vibration isolator 45 is disposed between the collar 44 and the lower case 12. A nut 46 is screwed on the outer peripheral surface of the cylindrical portion 41. The collar 44 and the vibration isolator 45 are held between the nut 46 and the flange portion 42. The space in which the impeller I is housed and the space in which the motor M is housed are partitioned by the vibration isolating material 45.

The motor M includes a rotor 50, a stator 54, coils 55, insulators 56, and a printed circuit board 57. The rotor 50 includes the rotary shaft 51, a yoke 52, and a magnet 53. The yoke 52 is fixed to the rotary shaft 51. The magnet 53 is held on the outer peripheral portion of the yoke 52. The magnet 53 is cylindrical and magnetized to different polarities in the circumferential direction. The rotary shaft 51, the yoke 52, and the magnet 53 rotate integrally. The stator 54 is disposed radially outside the magnet 53. The coils 55 are wound around the stator 54 via the insulators 56, respectively. The coils 55 are electrically connected to the printed circuit board 57. The printed circuit board 57 is disposed on the side opposite to the impeller I with respect to the rotor 50, the stator 54, the coils 55, and the insulators 56. The printed circuit board 57 is connected to a wire C1 as described later, and is connected to an electronic circuit provided outside the motor M via the wire C1, whereby energization of the coils 55 is controlled. When the coils 55 are energized, a magnetic force is generated between the stator 54 and the magnet 53. Thus, the impeller I rotates together with the rotor 50.

The printed circuit board 57 is connected to the wire C1. The wire C1 supplies electric power to the motor M. In detail, the wire C1 energizes the coils 55. Although only one line C1 is illustrated in FIG. 1, three lines C1 are arranged from the front of the paper to the back in the present embodiment.

An opening 21 is formed in a part of a lower side wall of the motor case 20. The grommet case 30 is attached to the motor case 20 so as to cover the opening 21. Three holes h1 are formed in the grommet 70 held in the grommet case 30, as will be described in detail later. The three wirings C1 are inserted through the three holes h1, respectively. The grommet 70 is formed with five holes h2. The five holes h2 are closed by the plug members 80. The grommet 70 is formed with three insertion holes 31 through which the three wires C1 are respectively inserted. the grommet 70 is formed with five insertion holes 32 corresponding to the five holes h2. Details will be described later.

[Grommet and Plug Member]

Figure 2A:
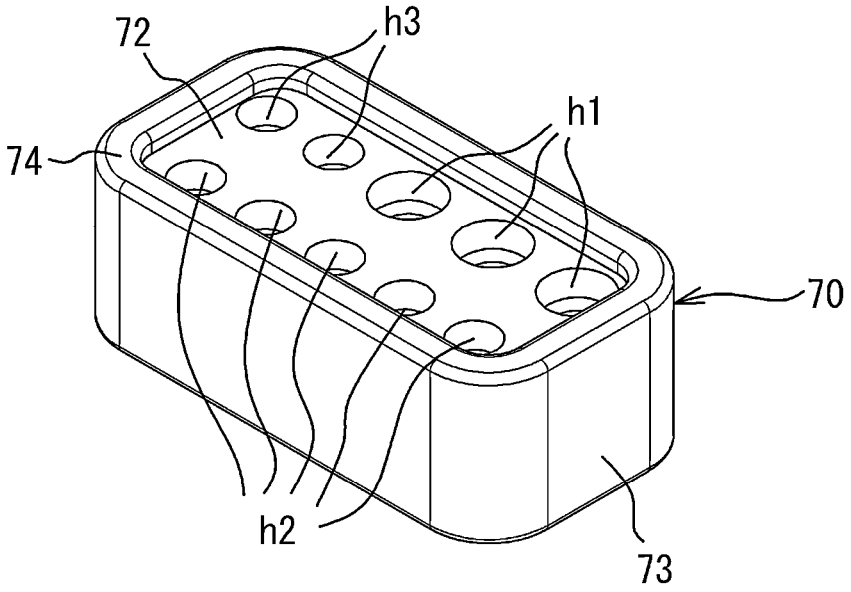
FIGS. 2A and 2B are external perspective views of a grommet.
Figure 2B:
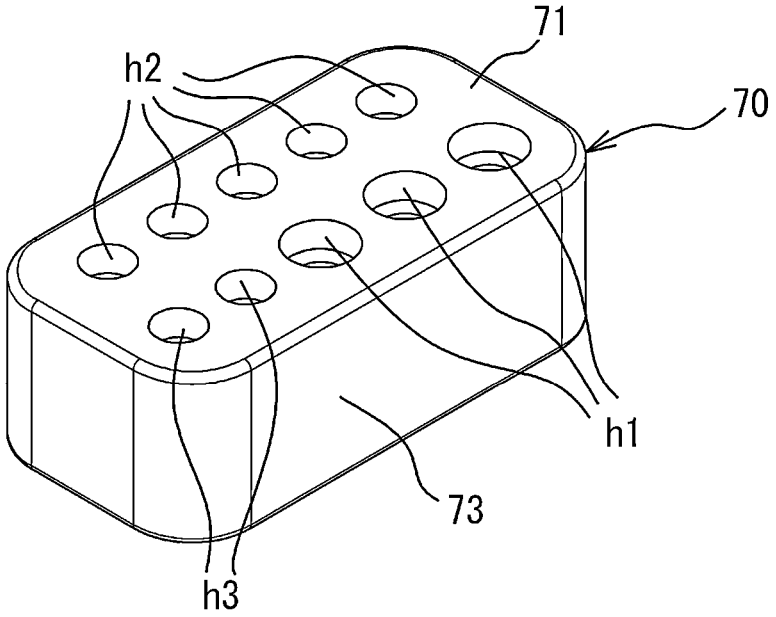

FIGS. 2A and 2B are external perspective views of the grommet 70. The grommet 70 is made of rubber. The grommet 70 includes an inner surface 71, an outer surface 72, and an outer peripheral surface 73. The inner surface 71 and the outer surface 72 face each other. As illustrated in FIG. 1, the inner surface 71 faces the inside of the motor case 20, and the outer surface 72 faces the outside of the motor case 20. A rib 74 is formed on the outer peripheral edge of the outer surface 72 so as to protrude from the outer surface 72. The grommet 70 has a plurality of holes h1, h2, and h3 formed through the inner surface 71 and the outer surface 72. In the present embodiment, three holes h1, five holes h2, and two holes h3 are formed in the grommet 70. A diameter of the hole h1 is larger than a diameter of each of the holes h2 and h3. Diameters of the hole h2 and the h3 are substantially the same. The five holes h2 are arranged in the longitudinal direction of the grommet 70. The three holes h1 and the two holes h3 are arranged in the longitudinal direction of the grommet 70 at a different level from the five holes h2. The grommet case 30 is formed with the three insertion holes 31 corresponding to the three holes h1, respectively, the five insertion holes 32 corresponding to the five holes h2, respectively, and two insertion holes corresponding to the two holes h3, respectively. The insertion hole formed in the grommet case 30 is not limited to this configuration. For example, the insertion hole formed in the grommet case 30 may be an elongated hole corresponding to at least two of the holes h1, h2, and h3. For example, one elongated insertion hole corresponding to the three holes h1 and the two holes h3 and one elongated insertion hole corresponding to the five holes h2 may be formed in the grommet case 30.

The hole h1 is formed for insertion of the wire C1 for supplying electric power to the motor M as described above. The hole h2 is formed for insertion of a wire connected to a position sensor not used in the blower 1 of FIG. 1 and detecting the rotational position of the rotor 50. The hole h3 is formed for insertion of a wire connected to a temperature sensor not used in the blower 1 of FIG. 1 and detecting the temperature of the motor M. The position sensor is, for example, a Hall element. The temperature sensor is, for example, a thermistor.

Figure 3A:
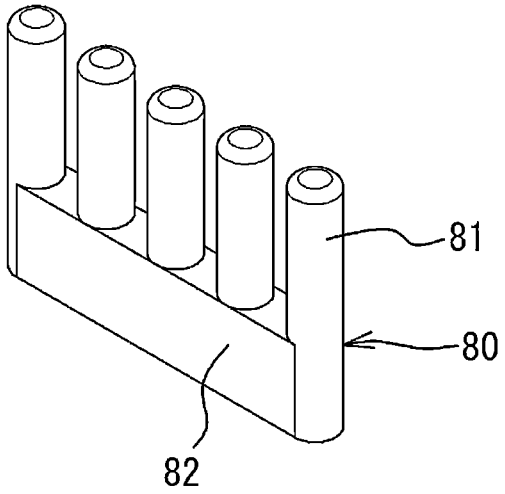
FIGS. 3A and 3B are external perspective views of plug members.
Figure 3B:
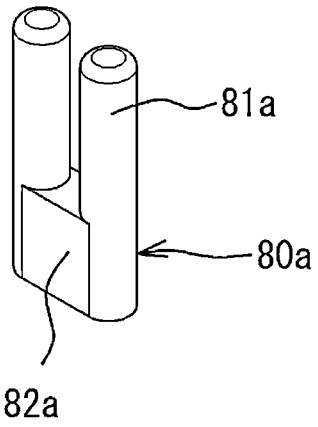

FIGS. 3A and 3B are external perspective views of the plug member 80 and a plug member 80*a*. The plug member 80 includes five insertion portions 81 and a support portion 82 that supports the five insertion portions 81. The five insertion portions 81 extend in parallel with equal interval therebetween. The support portion 82 is formed in a substantially plate shape. The plug member 80*a* includes two insertion portions 81*a* and a support portion 82*a* that supports the two insertion portions 81*a*. The two insertion portions 81*a* extend in parallel with an equal interval therebetween. The support portion 82*a* connects the proximal end sides of the two insertion portions 81*a*. The plug member 80 closes the holes h2. The plug member 80*a* closes the holes h3. The plug members 80 and 80*a* are made of plastic. The plug members 80 and 80*a* are more rigid than the grommet 70.

Figure 4A:
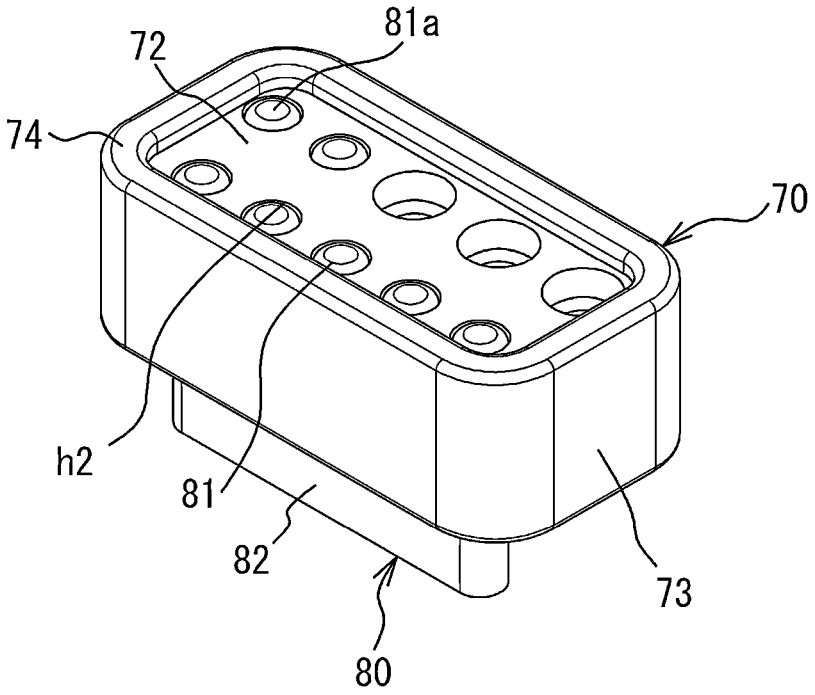
FIGS. 4A and 4B are external perspective views of the grommet and plug members used in the first model of the blower.
Figure 4B:
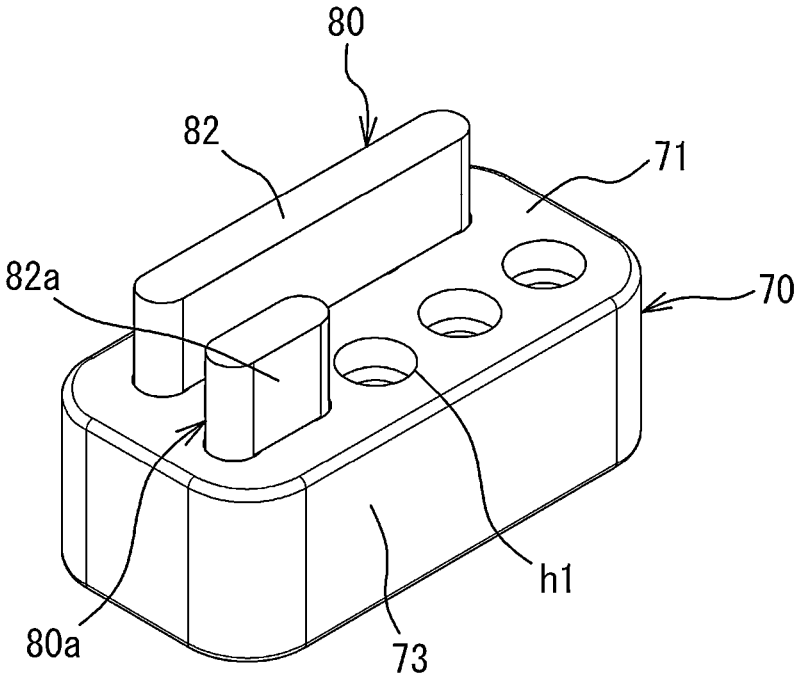

FIGS. 4A and 4B are external perspective views of the grommet 70, the plug member 80 and the plug member 80*a* used in the blower 1 of the first model. The insertion portion 81 of the plug member 80 is inserted into the holes h2 from the inner surface 71 of the grommet 70. Similarly, the insertion portion 81*a* of the plug member 80*a* is inserted into the hole h3 from the inner surface 71. As a result, the holes h2 and h3 of the grommet 70, which are not used in the blower 1, are closed. Therefore, the airtightness of the blower 1 is ensured. Since the holes h1 are formed for insertion of the wires C1 for supplying electric power to the motor M as described above, the holes h1 are not closed by the plug members 80 and 80*a*. The hole h1 corresponds to a first hole. The holes h2 and h3 correspond to the second hole.

The support portion 82 has such a size as not to be inserted into the hole h2. Similarly, the support portion 82*a* has such a size as not to be inserted into the hole h3. Thus, as illustrated in FIG. 1, the plug members 80 and 80*a* are restricted from being pulled out of the grommet 70 to the outside of the motor case 20. In FIG. 1, the plug member 80*a* is located on the front side of the paper.

In addition, the five insertion portions 81 are supported by the support portion 82. Therefore, the operator can insert the five insertion portions 81 into the five holes h2 of the grommet 70 at the same time by holding the support portion 82. The same applies to the plug member 80*a*. In this way, workability is ensured.

The plug members 80 and 80*a* are made of plastic, and the grommet 70 is made of rubber. Therefore, each of the plug members 80 and 80*a* has a higher rigidity than the grommet 70. Therefore, the friction force between the grommet 70 and each of the plug members 80 and 80*a* is reduced. This facilitates insertion of the insertion portions 81 and 81*a* into the holes h2 and h3 of the grommet 70, respectively. In this way, workability is ensured.

Next, the restriction of the removal of the plug member 80 from the grommet 70 to the inside of the motor case 20 will be described. A situation in which such removal may occur is, for example, a case where the user of the blower 1 presses the distal ends of the insertion portions 81 and 81*a* respectively exposed from the holes h2 and h3 with a pen tip or the like as illustrated in FIG. 4A. As described above, in order to ensure the airtightness of the blower 1, it is desirable to restrict the plug member 80 from being removed from the grommet 70 to the inside of the motor case 20. In such a case, the plug member 80 may be bonded to the grommet 70 with an adhesive. However, adhesives are undesirable from a management standpoint at the manufacturing site. Further, the use of the adhesive may be limited depending on the application of the blower. Therefore, the blower 1 according to the present embodiment has the following structure.

Figure 5A:
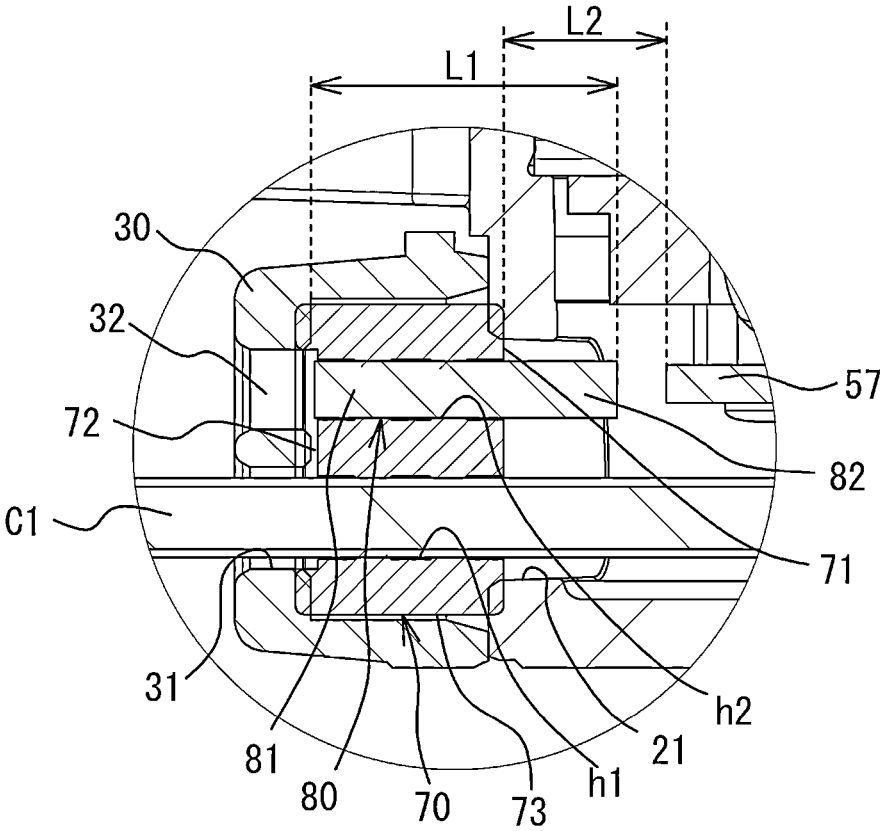
FIGS. 5A and 5B are explanatory views of restriction of removal of the plug member from the grommet to an inside of a motor case.
Figure 5B:
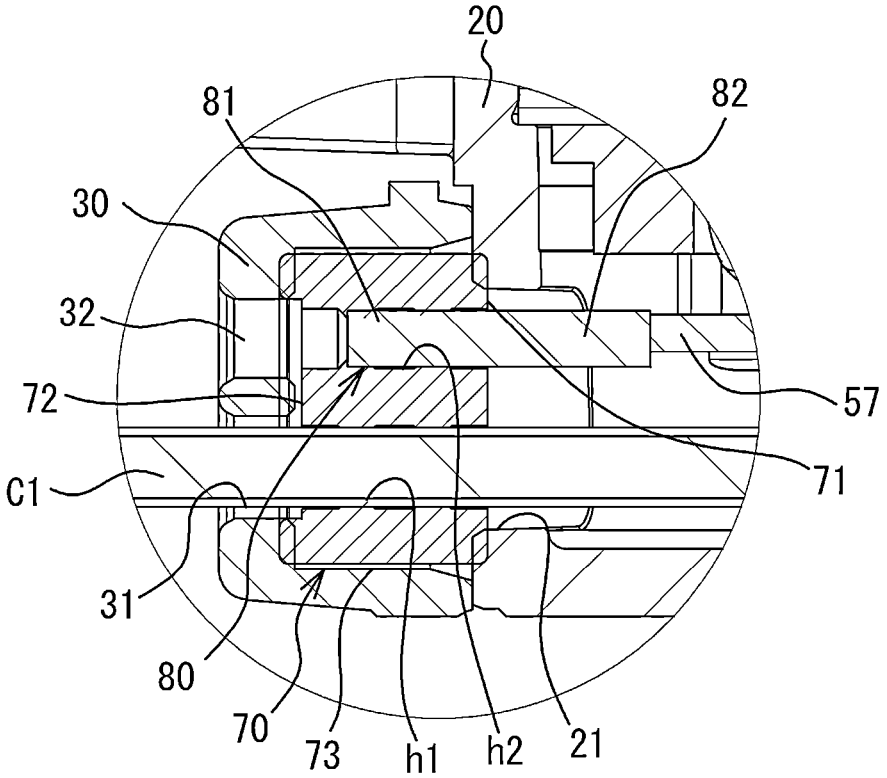

FIGS. 5A and 5B are explanatory views of the restriction of the removal of the plug member 80 from the grommet 70 to the inside of the motor case 20. The edge of the printed circuit board 57 is present on an extension line of the hole h2 in the axial direction. Here, the length L1 of the plug member 80 in the axial direction of the hole h2 is longer than the distance L2 from the inner surface 71 of the grommet 70 to the edge of the printed circuit board 57 in the same direction. Therefore, even when the plug member 80 moves toward the inside of the motor case 20 from a state where the insertion portion 81 of the plug member 80 is inserted into the hole h2 as illustrated in FIG. 5A, the support portion 82 comes into contact with the edge of the printed circuit board 57 before the plug member 80 falls off from the grommet 70 as illustrated in FIG. 5B. In this way, the plug member 80 is restricted from being removed from the grommet 70 toward the inside of the motor case 20. In the present embodiment, the edge of the printed circuit board 57 is not present on the extension line of the hole h3 in the axial direction thereof. Therefore, when the plug member 80*a* moves to the inside of the motor case 20 from a state where the insertion portion 81*a* of the plug member 80*a* is inserted, the support portion 82*a* may be removed from the grommet 70 of the plug member 80*a* to the inside of the motor case 20 without contacting the edge of the printed circuit board 57.

In such a case, the insulator 56 may be used instead of the printed circuit board 57. For example, a wall may be provided in a part of the insulator 56 or the relative position between the grommet 70 and the motor M may be changed such that the insulator 56 is positioned on the extension lines of the holes h2 and h3 in the axial direction thereof.

In this way, the plug member is restricted from being pulled out from the grommet 70 to the inside of the motor case 20 without using an adhesive or the like, and the airtightness is ensured.

The plug members 80 and 80*a* are different in brightness of color from the grommet 70. In the present embodiment, the color of the plug members 80 and 80*a* is black, and the color of the grommet 70 is also black. However, as described above, the brightness is different. As illustrated in FIG. 4A, the distal ends of the insertion portions 81 and 81*a* are exposed from the holes h2 and h3, respectively. Therefore, the distal ends of the insertion portions 81 and 81*a* are visually recognized through the insertion hole 32 of the grommet case 30 holding the grommet 70. Therefore, after the blower 1 is completed, it is easy to check whether the holes h2 and h3 of the grommet 70 are appropriately closed by the plug members 80 and 80*a*, respectively. The color of the plug members 80 and 80*a* and the color of the grommet 70 are not limited to black.

[Second, Third, and Fourth Models of Blowers]

Figure 6:
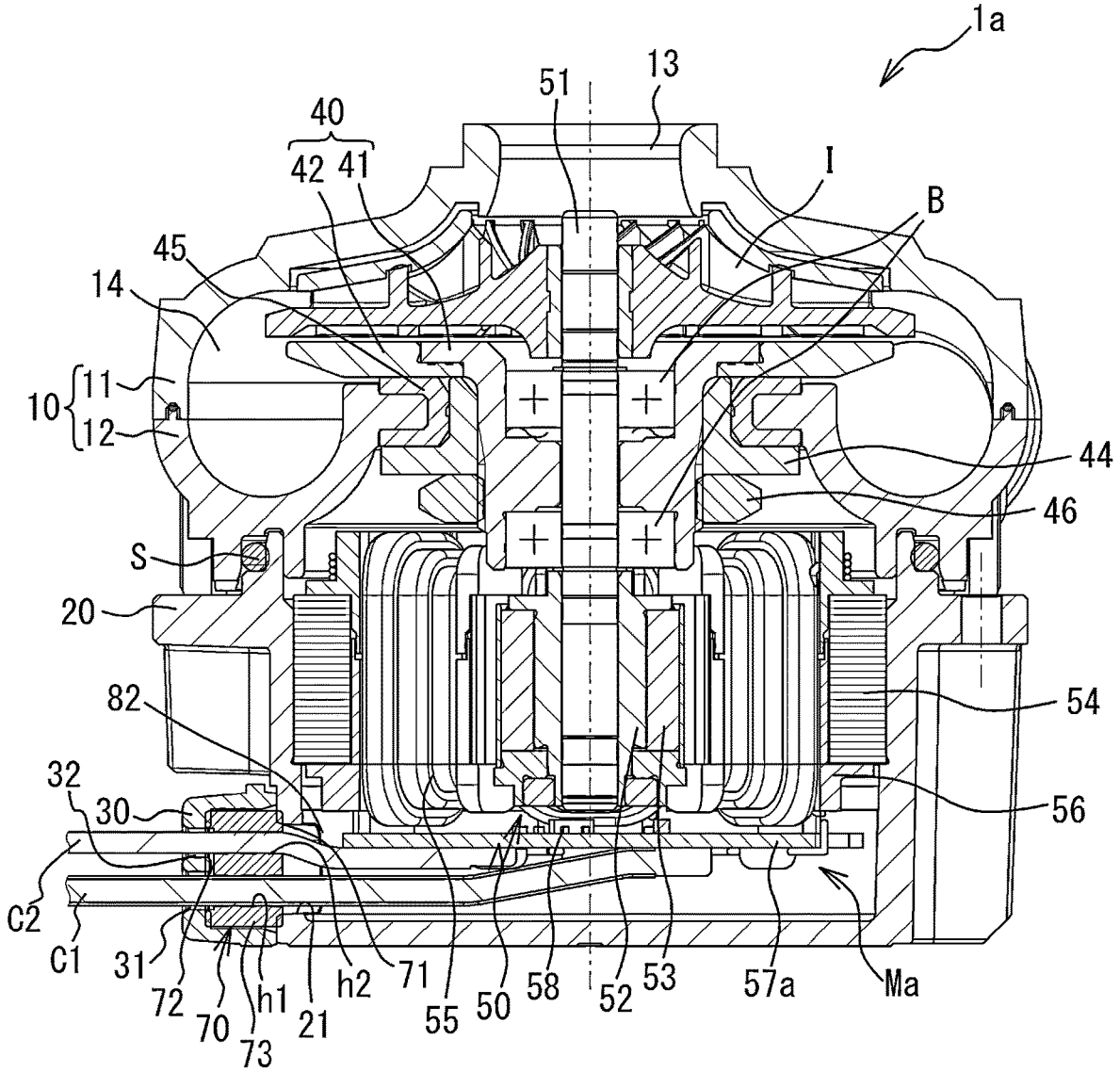
FIG. 6 is a sectional view of a second model of a blower.

FIG. 6 is a sectional view of a blower 1*a* of the second model. The blower 1*a* will be described only in terms of differences from the blower 1. The blower 1*a* is different in model from the blower 1. A position sensor 58 for detecting the rotational position of the rotor 50 is provided on a printed circuit board 57*a* of a motor Ma of the blower 1*a*. Five wires C2 are connected to the position sensor 58 via the printed circuit board 57*a*. The wire C2 is inserted through the hole h2 of the grommet 70. Therefore, in the blower 1*a*, the plug member 80 is not inserted into the holes h2 of the grommet 70.

Figure 7A:
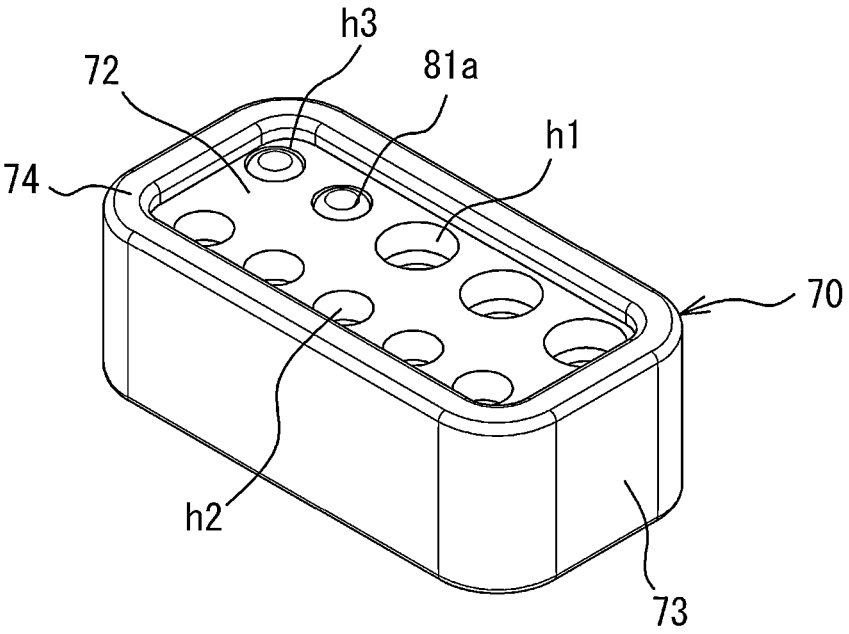
FIGS. 7A and 7B are external perspective views of the grommet and the plug members used in the second model of the blower.
Figure 7B:
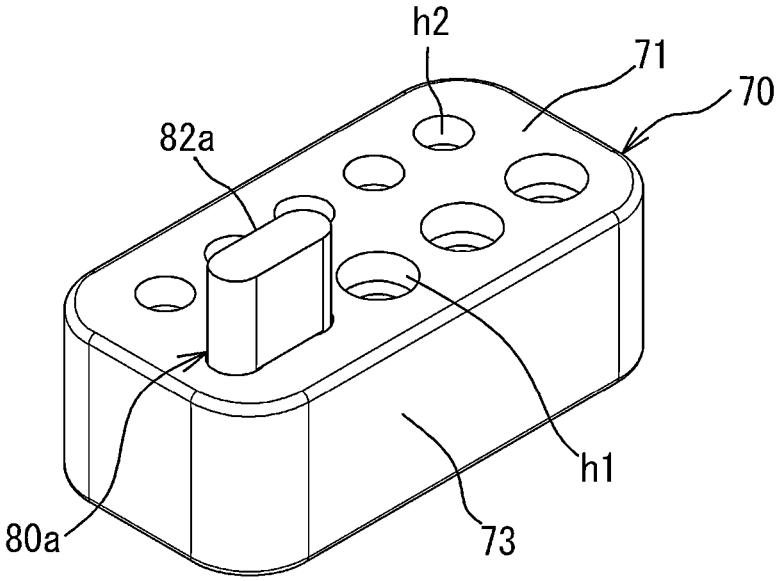

FIGS. 7A and 7B are external perspective views of the grommet 70 and the plug member 80*a* used in the blower 1*a* of the second model. The blower 1*a* is not provided with a temperature sensor for detecting the temperature of the motor Ma, and therefore the holes h3 are closed by the plug member 80*a*. Thus, the airtightness of the blower 1*a* is ensured.

Figure 8A:
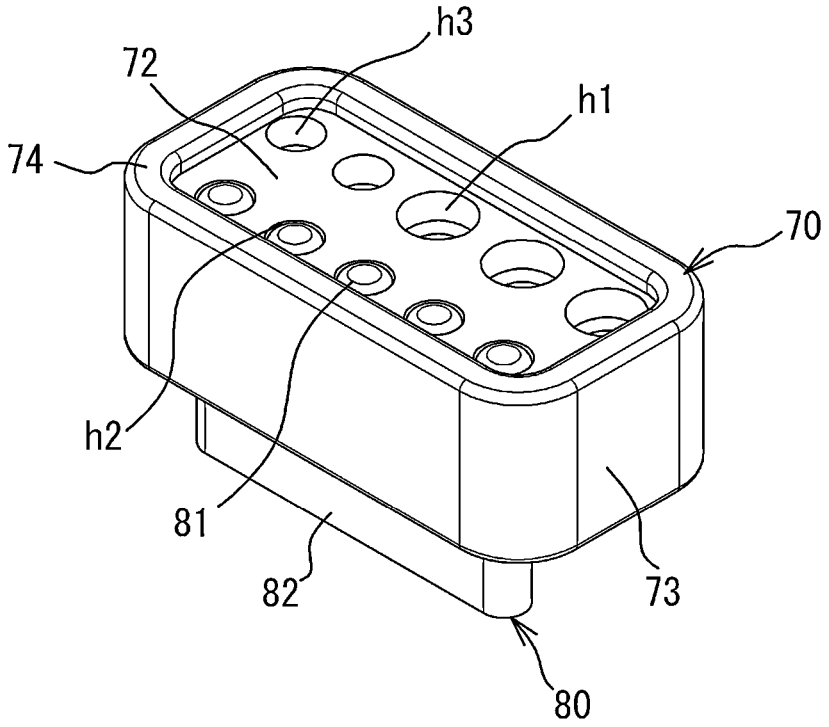
FIGS. 8A and 8B are external perspective views of the grommet and the plug member used in a third model of a blower.
Figure 8B:
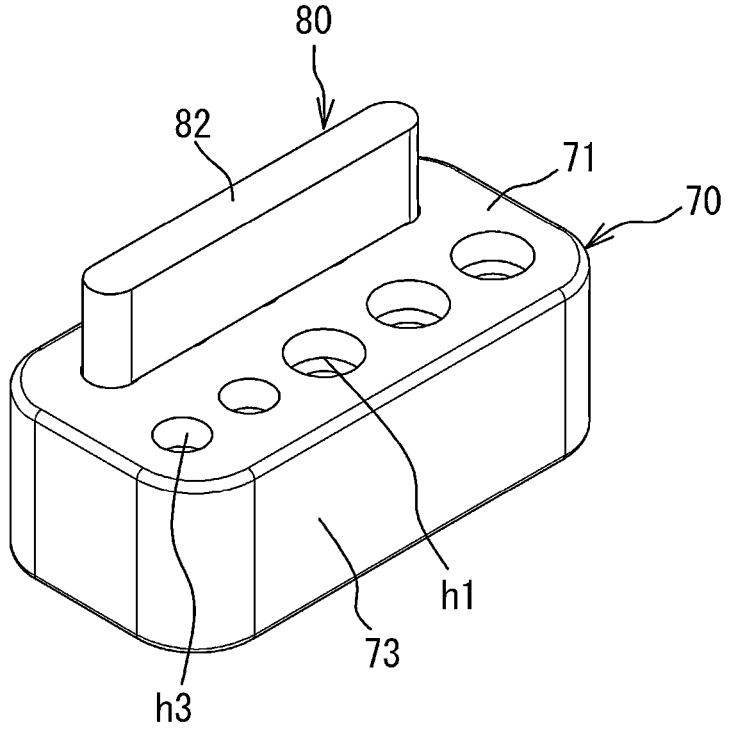

FIGS. 8A and 8B are external perspective views of the grommet 70 and the plug member 80 used in the third model of a blower. The blower of the third model does not include a position sensor for detecting the rotational position of the rotor 50, but includes a temperature sensor for detecting the temperature of the motor. In this case, only the holes h2 of the grommet 70 are closed by the plug member 80. A blower of a fourth model includes a position sensor and a temperature sensor. Therefore, in the blower of the fourth model, the grommet 70 is used without using the plug members 80 and 80*a*.

As described above, the grommet 70 is shared by a plurality of models of blowers, and the versatility of the grommet 70 is improved. Therefore, the manufacturing cost is suppressed as compared with the case where a grommet dedicated to each model is manufactured. As described above, the holes h1 are not closed by the plug member.

[Variation of Plug Member]

Figure 9A:
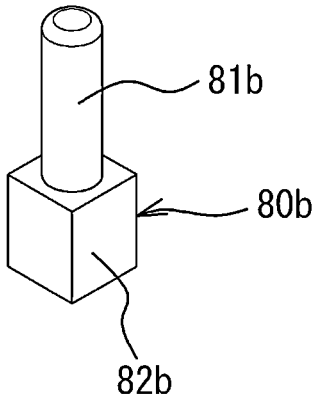
FIG. 9A is an external perspective view of a plug member of a first variation.

FIG. 9A is an external perspective view of a plug member 80*b* of a first variation. The plug member 80*b* includes one insertion portion 81*b* and a support portion 82*b* for supporting the insertion portion 81*b*. The insertion portion 81*b* has a cylindrical shape, and the support portion 82*b* has a prismatic shape. The width of the support portion 82*b* is larger than the diameter of the insertion portion 81*b*. Therefore, the support portion 82*b* has such a size as not to be inserted into each of the holes h2 and h3.

Figure 9B:
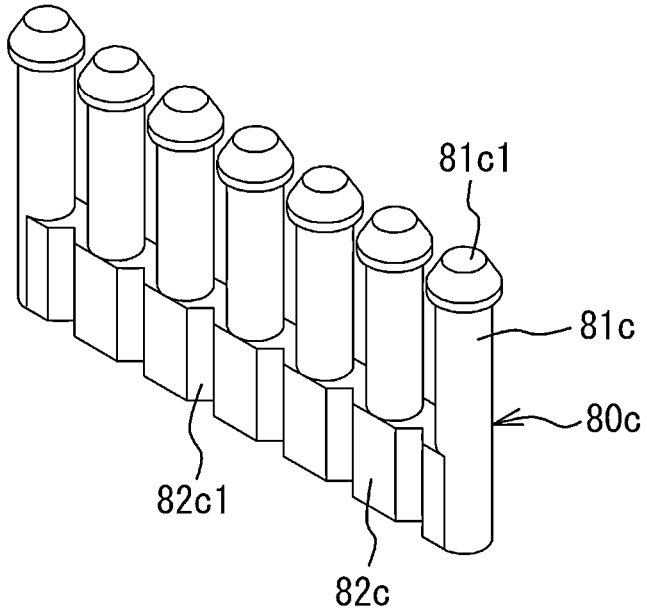
FIG. 9B is an external perspective view of a plug member of a second variation.

FIG. 9B is an external perspective view of a plug member 80*c* of a second variation. The plug member 80*c* includes six insertion portions 81*c* and a support portion 81*c* that supports the six insertion portions 82*c*. A diameter-increased portion 81*c*1 is formed at the distal end of the insertion portion 81*c*. The diameter-increased portion 81*c*1 protrudes from the tip of the hole in a state where the insertion portion 81*c* is inserted into the hole of the grommet, and thus the insertion portion 81*c* is restricted from being pulled out from the hole. In the support portion 82*c*, a groove portion 82*c*1 is formed between the insertion portions 81*c* adjacent to each other. The operator can divide the support portion 82*c* by bending the support portion 82*c* about the groove portion 82*c*1.

The number, size, position, and shape of the holes h1, h2, and h3 are not limited to the examples illustrated in FIGS. 2A and 2B, and the like. The grommet 70 may be provided with holes for inserting wiring for applications other than wiring for supplying power to the motor and wiring connected to the position and temperature sensors. For example, a hole may be provided for inserting a wiring connected to a torque sensor, a speed sensor, an acceleration sensor, a vibration sensor, an atmospheric pressure sensor, or the like.

While the exemplary embodiments of the present disclosure have been illustrated in detail, the present disclosure is not limited to the above-mentioned embodiments, and other embodiments, variations and variations may be made without departing from the scope of the present disclosure.

What is claimed is:

1. A blower comprising:

a case having an opening;

an impeller disposed in the case;

a motor disposed in the case and configured to drive the impeller, the motor including a printed circuit board;

a grommet disposed in the case;

a wiring; and a plug member, wherein the grommet includes first and second holes that communicate between an inside and an outside of the case via the opening, the wiring is inserted into the first hole, the plug member closes the second hole, the plug member includes:

an insertion portion inserted into the second hole, and a support portion having such a size as not to be inserted into the second hole and supporting the insertion portion, the support portion is located inside the case with respect to the insertion portion, the plug member is restricted from being pulled out of the second hole to the outside of the case due to the size of the support portion that restricts the support portion from being inserted into the second hole, the insertion portion is restricted from being pulled out of the second hole to the inside of the case by contact of the support portion with the printed circuit board, and a length of the plug member in an axial direction of the second hole is longer than a distance from an inner surface of the grommet to an edge of the printed circuit board.

2. The blower according to claim 1, wherein (i) in a first state in which the insertion portion is fully inserted into the second hole, a space exists between the support portion and the printed circuit board, and (ii) the contact of the support portion with the printed circuit board occurs in a second state in which the plug member has been shifted toward the inside of the case and partially withdrawn from the second hole.

3. The blower according to claim 1, wherein the second hole comprises a plurality of second holes, the insertion portion comprises a plurality of insertion portions, and the support portion comprises a single support portion that supports the plurality of insertion portions.

* * * * *